US009617047B2

(12) United States Patent
Goettke et al.

(10) Patent No.: US 9,617,047 B2
(45) Date of Patent: Apr. 11, 2017

(54) CONTAINER

(71) Applicant: RPC Bramlage GmbH, Lohne (DE)

(72) Inventors: Sabine Goettke, Lohne (DE); Heinrich Deters, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 14/390,442

(22) PCT Filed: Mar. 28, 2013

(86) PCT No.: PCT/EP2013/056729
§ 371 (c)(1),
(2) Date: Oct. 3, 2014

(87) PCT Pub. No.: WO2013/149943
PCT Pub. Date: Oct. 10, 2013

(65) Prior Publication Data

US 2015/0175322 A1 Jun. 25, 2015

(30) Foreign Application Priority Data

Apr. 5, 2012 (DE) ..... 20 2012 101 254 U

(51) Int. Cl.
*B65D 45/34* (2006.01)
*B65D 43/02* (2006.01)
*B65D 50/04* (2006.01)

(52) U.S. Cl.
CPC ..... *B65D 45/34* (2013.01); *B65D 43/0204* (2013.01); *B65D 50/045* (2013.01); *B65D 2215/02* (2013.01); *B65D 2215/06* (2013.01); *B65D 2543/0074* (2013.01); *B65D 2543/00083* (2013.01); *B65D 2543/00296* (2013.01);
(Continued)

(58) Field of Classification Search
CPC .. B65D 45/34; B65D 50/045; B65D 43/0204; B65D 2215/02; B65D 2543/00083; B65D 2543/00296; B65D 2215/06; B65D 2543/00703; B65D 2543/0074;
(Continued)

(56) References Cited

U.S. PATENT DOCUMENTS 3,023,925 A * 3/1962 Sher ..... B65D 39/14 206/1.5
4,212,415 A * 7/1980 Neely ..... B65D 83/06 220/324
(Continued)

FOREIGN PATENT DOCUMENTS

DE 20 2010 005 632 U1 10/2011
WO 2009/053693 A 4/2009

OTHER PUBLICATIONS

International Search Report of PCT/EP2013/056729, mailed Jun. 10, 2013.

*Primary Examiner* — James N Smalley
(74) *Attorney, Agent, or Firm* — Collard & Roe, P.C.

(57) ABSTRACT

A container with a lower part and a covering part has a latch portion which protrudes downwards formed on the covering part in order to interact with a latch engagement part of the lower part, a latching tongue which extends along the lower part being formed on the latch portion. The latching tongue extends below the latch engagement part of the container in the closed state so as to leave a direct open space between the inner face of the latching tongue and an opposing outer face of the container.

2 Claims, 3 Drawing Sheets

(52) U.S. Cl.
CPC ..... *B65D 2543/00537* (2013.01); *B65D 2543/00574* (2013.01); *B65D 2543/00648* (2013.01); *B65D 2543/00703* (2013.01); *B65D 2543/00814* (2013.01)

(58) Field of Classification Search
CPC ..... B65D 2543/00814; B65D 2543/00648; B65D 2543/00574; B65D 2543/00537
USPC ..... 220/324, 326, 784, 788; 215/216; 401/172
See application file for complete search history.

(56) References Cited

U.S. PATENT DOCUMENTS 4,746,008 A * 5/1988 Heverly ..... B65D 55/02 206/1.5
5,275,496 A * 1/1994 Fattori et al. ..... 401/68
5,348,549 A * 9/1994 Brown ..... A61B 50/362 206/366
5,551,589 A * 9/1996 Nakamura ..... H02G 3/14 220/326
5,577,779 A * 11/1996 Dangel ..... E05C 19/06 220/326
5,979,691 A * 11/1999 Von Holdt ..... B65D 43/0256 220/266
7,413,479 B1 * 8/2008 Volpone ..... H01R 13/506 174/138 F
2005/0205648 A1 * 9/2005 Erdie ..... B65D 43/021 229/5.5
2007/0079413 P1 * 4/2007 Kawashima ..... Plt./318
2007/0095838 A1 * 5/2007 Roesler ..... B65D 43/021 220/326
2007/0187288 A1 * 8/2007 Haggard et al. ..... 206/711
2011/0079413 A1 * 4/2011 Masumoto ..... H02G 3/0675 174/50

* cited by examiner

CONTAINER

CROSS REFERENCE TO RELATED APPLICATIONS

This application is the National Stage of PCT/EP2013/056729 filed on Mar. 28, 2013, which claims priority under 35 U.S.C. §119 of German Application No. 20 2012 101 254.5 filed on Apr. 5, 2012, the disclosure of which is incorporated by reference. The international application under PCT article 21(2) was not published in English.

The invention relates to a container having a lower part and a cover part, a downwardly projecting latching portion being formed on the cover part for cooperating with a latching engagement part of the lower part, a latching tongue which extends along the lower part also being formed on the latching portion.

Reference is first made to DE 20 2010 005 632 U1 with respect to a comparable container. In this known container, a tab which extends in a tab-like manner and with clearance from an outer wall of the lower part, but integrally therewith, is formed on said lower part and comprises a latching projection which engages in a latching recess of the latching tongue from the inside. The tab extends further downwards than the latching tongue. To unlatch it, the tab is pressed towards the container wall and then the latching tongue is moved in the same direction to also release from the counter-latch a further latch which cooperates with a counter-latch part of the lower part which overlaps the latching tongue on the outside, and then the cover is gripped by the other hand and pulled upwards to remove the cover part from the lower part.

Reference is also made to the prior art document U.S. Pat. No. 4,746,008. Latching portions are formed on the lid part in the container that is known therefrom and is substantially rectangular in plan view, which latching portions are positioned on an edge of the container that extends in a straight line.

The problem addressed by the invention is that of providing a container of which the cover part is held on the lower part in a childproof manner but can also be advantageously detached from the lower part after overcoming the safety measures.

This problem is solved by the subject matter of an embodiment of the invention, it being based upon the fact that the container has an oval cross section and that a latching tongue is positioned on a narrow side of the oval, the latching tongue being formed so as to extend in a curved manner transverse to the vertical longitudinal extension thereof and the clearance being provided over the entire width of the latching tongue and also in the region of the lower end face of the latching tongue, it simultaneously being possible to release the lower part from the latching engagement part by freely moving the latching tongue towards the outer wall of the lower part, and that the latching engagement part is strip-like and has a narrow side pointing vertically upwards and vertically downwards in cross section, the latching engagement part also continuing in a horizontal orientation in the peripheral direction of the container so as to surround the lower part, the latching engagement part extending over part of the periphery with a clearance in the horizontal plane, two opposing latching tongues also being formed on the container, which tongues can be acted upon simultaneously for lifting the cover part in a movement towards the outer face of the container and the clearance, starting from the region of cooperation between the latching engagement part and each of the two latching tongues, continuing in both horizontal directions of the latching engagement part whilst decreasing, up to a dimension based on a cross section which corresponds to from one tenth to one third of the free cross-sectional dimension, which is the largest cross-sectional dimension based on an oval cross section.

A container formed in this manner allows the latching tongues to move freely towards the outer wall of the lower part. As result, release from the latching engagement part of the lower part can take place at the same time. Since the lower edge of the latching tongues is thus also not covered by part of the lower part, each latching tongue can, by means of pressure on said undersides of the latching tongues, also be moved upwards in this position in which it is pressed against the outer wall of the lower part, whereby release from the latching engagement part can also take place in a vertical direction, and then the cover part can be easily removed from the lower part.

Since the container has an oval cross section and a latching tongue is positioned on a narrow side of the oval, said container can be adapted to the user's hand particularly well. The oval cross section is preferably provided such that it is adapted to a hand which is open but not stretched out with respect to the position of the thumb and index finger.

The two opposing latching tongues can be acted upon simultaneously for lifting the cover part in a movement of each of the latching tongues towards an outer face of the lower part. Using such a simultaneous action, which is possible for example using the thumb and index finger of an adult hand in particular, a wedge effect of the latching tongues which have thus been pressed inwards towards each other and can simultaneously have the effect of lifting the cover also occurs. Said container can accordingly be handled such that the cover is almost automatically pushed upwards when the latching tongues are pressed in.

It is also preferable for a latching tongue to be formed so as to have a reinforcing rib on the side facing the lower part. As a result, the latching tongue can be formed so as to be comparatively rigid in its vertical extension. An inward movement, in order to achieve the above-described unlatching, thus transmits corresponding tensile force into the cover part, and this is conducive to the cover part pushing upwards almost automatically when the latching tongues are pressed in.

With respect to the strip-like latching engagement part, said part extends, based on a horizontal plane when the vessel is in a normal position, over the specified region of the periphery of the lower part with clearance from an outer wall of the lower part. Since the latching engagement part, outside of an engagement opening for the latching tongues, is also connected to the lower part by a horizontal wall, the lower part is significantly reinforced in this region.

The latching engagement part that is formed on the lower part is preferably strip-like and extends transverse to an extension direction of the latching tongues. It is further arranged so as to surround a wall of the lower part. In any case, the strip-like latching engagement part preferably extends with lateral clearance from the outer wall of the lower part over a certain part of the periphery of the lower part, based on a horizontal plane when the vessel is in a normal position. Since the latching engagement part, outside of an engagement opening for the latching tongues, is also connected to the lower part by a horizontal wall, the lower part is significantly reinforced in this region.

The peripheral region over which the strip-like latching engagement part preferably extends is provided, in this region, in the range of from 15% to 100% of the periphery of the lower part.

The invention is further described in the following with reference to the accompanying drawings, which however only show one embodiment. In the drawings.

Figure 1:
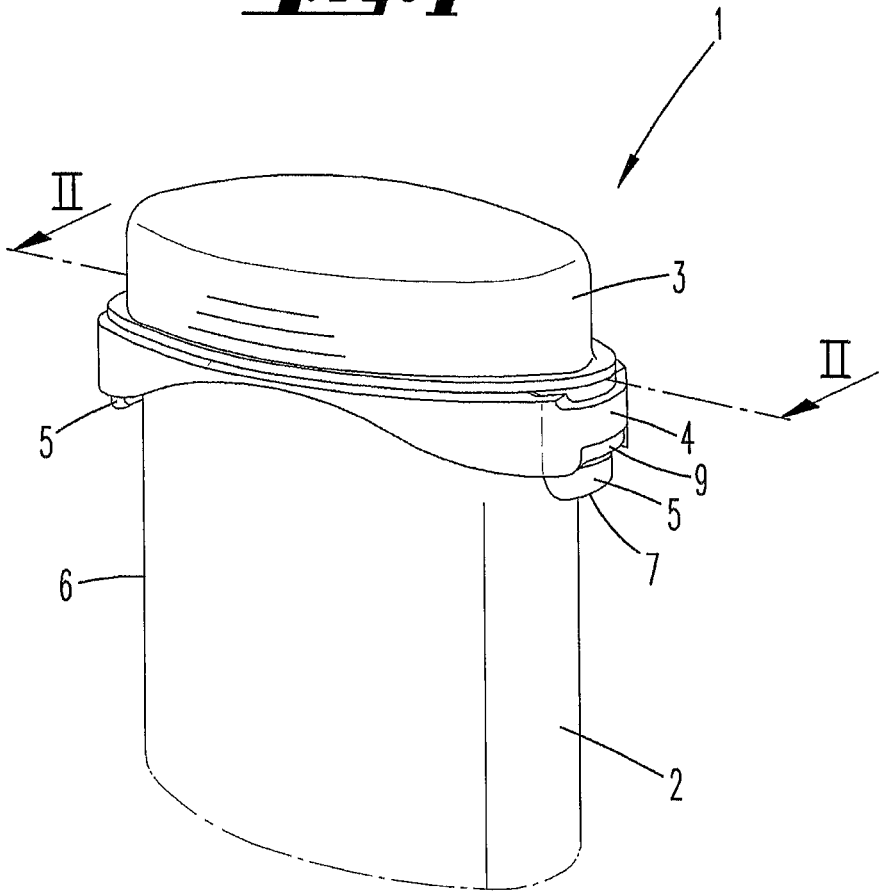
FIG. 1 is a perspective view of a container which is formed here as a deodorant stick.

First, with reference to FIG. 1, a container 1 is set out and described which comprises a lower part 2 and a cover part 3. The cover part 3 comprises a downwardly projecting latching portion for cooperating with a latching engagement part 4.

The latching engagement part 4 is connected to the lower part 2. The latching portion also comprises a latching tongue 5 which extends along the lower part in the vertical direction and extends, when the container is closed, as far as into a region below (when viewed from the outside according to the view in FIG. 1) the latching engagement part 4. The latching tongue 5 engages behind the latching engagement part 4 and also extends downwards. In particular, as can be seen from FIG. 2, the latching tongue 5 extends with horizontal clearance a from an outer face 6 of the lower part 2. This clearance a is provided in particular in the region of a lower end face 7 of the latching tongue 5.

In addition, the clearance a is, in any case, also provided in the region of a latching engagement 8 between a latching projection 9 formed on the outside of the latching tongue 5 and the latching engagement part 4.

Figure 2:
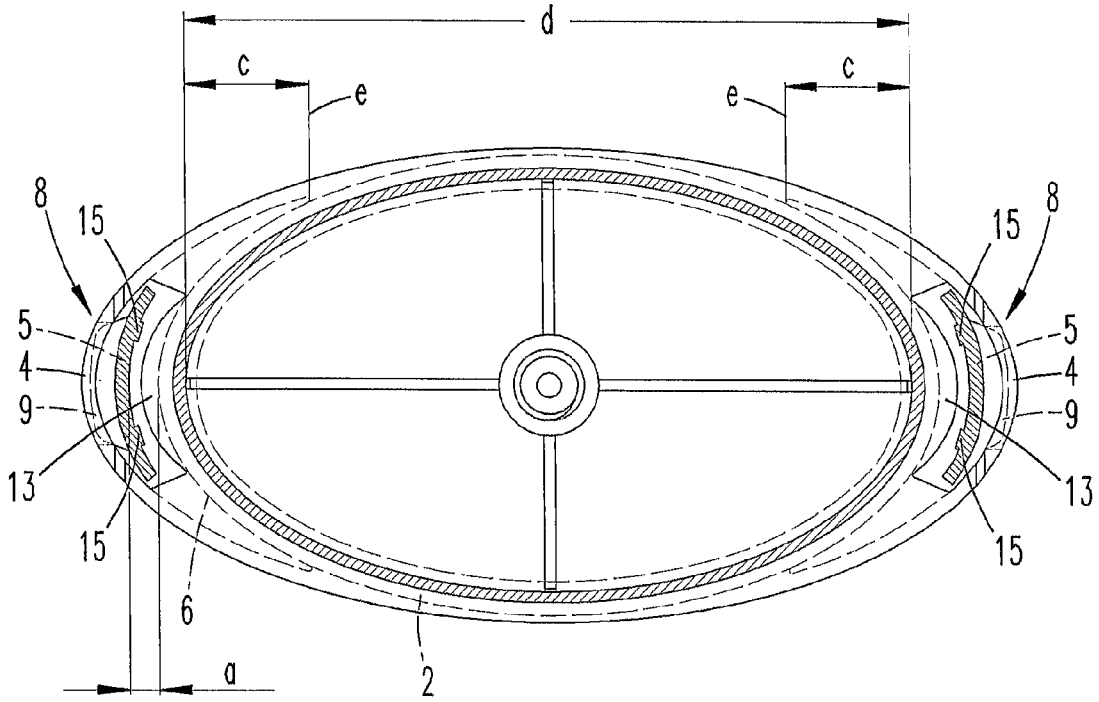
FIG. 2 is a cross section through the object according to FIG. 1 in the upper region, with the latching tongues in the latched position.
Figure 3:
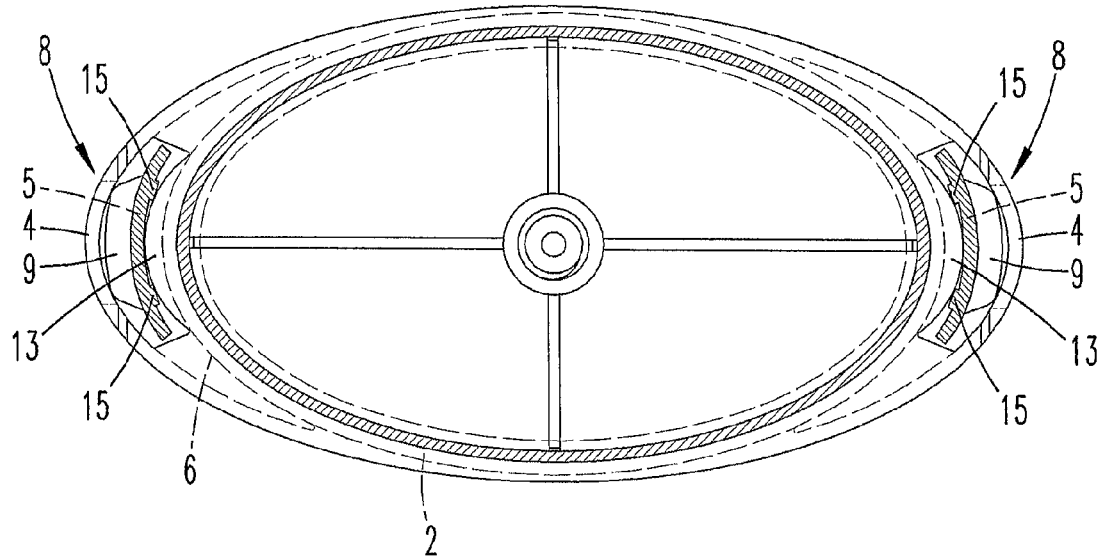
FIG. 3 is a view according to FIG. 2 with the latching tongues pressed in to release the cover part.

According to the cross section in FIGS. 2 and 3, the latching tongues 5 are preferably formed so as to extend in a curved manner over the width thereof. The clearance a is preferably provided over the entire width, and more preferably with the same dimensions over said width. The dimension a may, however, differ over the width, it being preferred for it to be greatest in the region of the latching rear engagement.

As can be seen from the dashed lines, it is thus possible for the latching tongues to be moved so far against the outer face 6 of the lower part 2 by being bent inwards that the latching projection 9 comes out of engagement with the latching engagement part 4.

Figure 4:
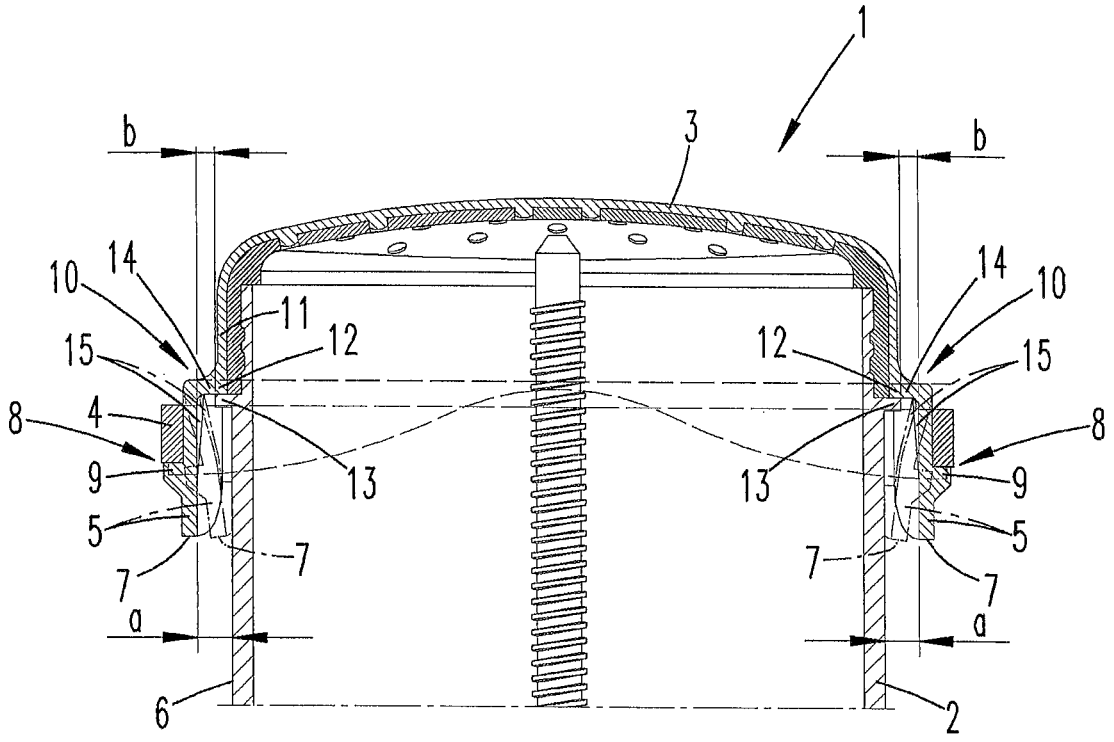
FIG. 4 is vertical section through the object according to FIG. 1 in the upper region, with the pressed-in position of the latching tongues being shown by dashed lines.

In a further detail, cf. in particular FIG. 4, the cover part 3 comprises a shoulder 10 which, as can be seen from the section in FIG. 4, is provided by the cover part wall 11, which is initially vertical in this respect, being horizontally turned outwards. On the inside, the shoulder 10 forms a contact region 12, which rests on an outwardly protruding contact projection 13 of the lower part 2.

The horizontal portion 14, forming the shoulder in this respect, of the wall of the cover part 3 then transitions into a vertical wall, which forms the latching tongues 5, with lateral clearance b from the contact projection 13.

The latching engagement part 4 is clearly strip-like, having a cross section shown in the vertical section according to FIG. 4, the narrow side of the cross section pointing vertically upwards and vertically downwards.

One vertical rib, or preferably two vertical ribs 15 in the embodiment, is moulded on the inside of a latching tongue 5. The vertical ribs 15 project inwards so as to face the outer face 6 of the lower part 2.

The container 1 preferably has, as can be seen from FIG. 1, an oval cross section overall. The latching tongues 5 are positioned on the narrow sides of the oval.

The latching engagement part 4 continues in a horizontal orientation in the peripheral direction of the container 1 so as to surround the lower part. In the embodiment, said latching engagement part completely surrounds the lower part, and preferably over part of the periphery with a clearance c in the same horizontal plane as described with respect to the latching part in cooperation with the latching tongue 5. Here, it is more preferable for the clearance c, starting from the region of cooperation between the latching engagement part and each of the two latching tongues, to continue in both horizontal directions of the latching engagement part whilst decreasing, approximately up to a dimension e based on a cross section as shown in FIGS. 2 and 3, which corresponds to from approximately one tenth to one third of the free cross-sectional dimension d, which is the largest cross-sectional dimension based on an oval cross section. Overall, over this strip width in said plane, a reinforcing ring is formed around this region of the lower part 2, in the vertical direction in the region of the latching tongues 5, and ensures increased stability.

All the disclosed features are essential to the invention (in isolation). The disclosure of the associated/accompanying priority documents (specification of the prior application) is hereby thus included in full in the disclosure of the invention, also for the purposes of incorporating features in said documents in the claims of the present application. In their optionally independent versions, the dependent claims characterise independent inventive developments of the prior art, in particular in order to make divisional applications on the basis of these claims.

LIST OF REFERENCE SIGNS

1 container
2 lower part
3 cover part
4 latching engagement part
5 latching tongue
6 outer face
7 end face
8 latching engagement
9 latching projection
10 shoulder
11 cover part wall
12 contact region
13 contact projection
14 horizontal portion
15 vertical ribs
a clearance
b clearance
c clearance
d cross-sectional dimension
e dimension

The invention claimed is:

1. A container having an oval cross section with first and second narrow sides, said container comprising:

(a) a lower part comprising an outer face;

(b) an annular latching engagement part comprising first and second latching engagement part strips extending vertically upward and downward and peripherally in a horizontal orientation so as to surround the lower part and form first and second peripheral clearances in a horizontal plane; and (c) a cover part comprising a downward projecting latching portion cooperating with the latching engagement part;

wherein the latching portion comprises opposing first and second latching tongues having respective first and second inner faces positioned on the first and second narrow sides, respectively, and extending along the lower part below the latching engagement part;

wherein the first and second latching tongues comprise respective first and second vertical longitudinal extensions, respective first and second widths, and respective first and second lower end faces and extend in a curved manner transverse to the first and second vertical longitudinal extensions, respectively;

wherein in a closed position, first and second direct clearances are formed between the respective first and second inner faces and the outer faces so as to extend entirely over the first and second widths, respectively, and in a respective region of the first and second lower end face;

wherein the lower part is releasable from the latching engagement part by freely moving the first and second latching tongues simultaneously toward the outer faces to lift the cover part; and wherein the first and second peripheral clearances extend circumferentially in the horizontal plane from respective first and second regions of cooperation between the latching engagement part and the first and second latching tongues and the first and second peripheral clearances taper normal to the outer face of the lower part from the respective first and second regions of cooperation to respective first and second minimum dimensions over a distance equal to one tenth to one third of a maximum inner diameter of the oval cross section.

2. The container according to claim 1, wherein the first latching tongue is formed so as to have a first reinforcing rib on the first inner face.

* * * * *